United States Patent [19]

Okayama et al.

[11] Patent Number: 4,809,415

[45] Date of Patent: Mar. 7, 1989

[54] METHOD OF MANUFACTURING A HEAT EXCHANGE PIPE

[75] Inventors: Yukihiro Okayama; Tadashi Matsumoto; Akio Yoshioka, all of Kanagawa, Japan

[73] Assignee: Tokyo Shibaura Denki Kabushiki Kaisha, Kawasaki, Japan

[21] Appl. No.: 11,039

[22] Filed: Feb. 5, 1987

Related U.S. Application Data

[62] Division of Ser. No. 538,554, Oct. 3, 1983, abandoned.

[30] Foreign Application Priority Data

Nov. 2, 1982 [JP] Japan ..... 57-193113

[51] Int. Cl.[4] ..... B21D 53/02

[52] U.S. Cl. ..... 29/157.3 AH; 29/157 R; 165/133

[58] Field of Search ..... 29/157.3 R, 157.3 H; 165/133; 72/203, 199, 365, 368, 377

[56] References Cited

U.S. PATENT DOCUMENTS

| | | | |
|---|---|---|---|
| 3,762,468 | 10/1973 | Newson et al. | 165/177 |
| 3,902,552 | 9/1975 | McLain | 165/179 |
| 4,532,789 | 8/1985 | Bruinsma et al. | 72/205 |
| 4,541,261 | 9/1985 | Yanodori et al. | 29/157.3 H |

FOREIGN PATENT DOCUMENTS

| | | | |
|---|---|---|---|
| 0121391 | 9/1980 | Japan | 29/157.3 H |
| 0014184 | 1/1982 | Japan | 29/157.3 H |
| 0209432 | 12/1983 | Japan | 29/157.3 H |
| 0209430 | 12/1983 | Japan | 29/157.3 H |

*Primary Examiner*—P. W. Echols
*Assistant Examiner*—Irene Cuda
*Attorney, Agent, or Firm*—Cushman, Darby & Cushman

[57] ABSTRACT

A heat-exchanging pipe having an inside surface formed with a plurality of ribs for enhancing turbulence of fluid flowing through the pipe. Each rib has an upstanding face portion formed on an upstream side of the rib and an inclined face portion descending from an upper end of the up-standing face portion in a downstream direction. The pipe is manufactured by roll forming a substantially flat piece of sheet metal material to form the ribs and then curling and joining ends of the sheet metal to form a substantially cylindrical pipe with the ribs on the inside surface thereof.

1 Claim, 4 Drawing Sheets

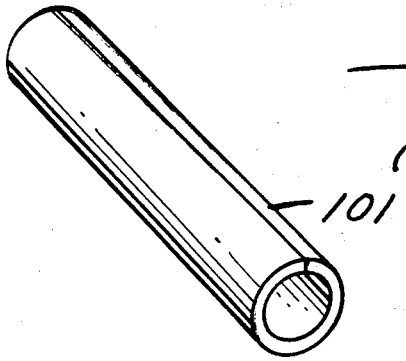
Fig. 1.
(PRIOR ART)
Fig. 2.
(PRIOR ART)
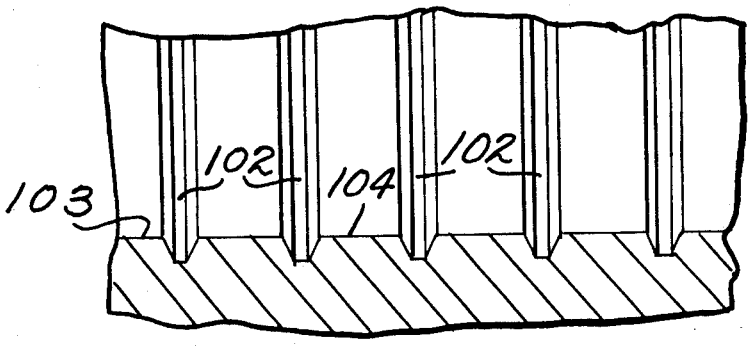
Fig. 3.
(PRIOR ART)
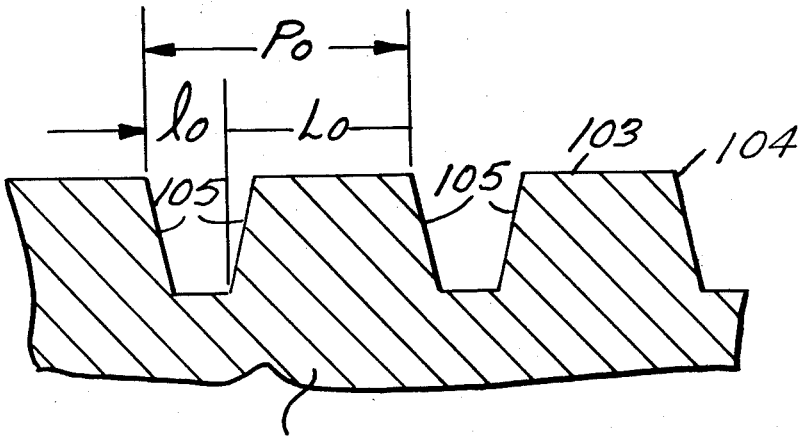

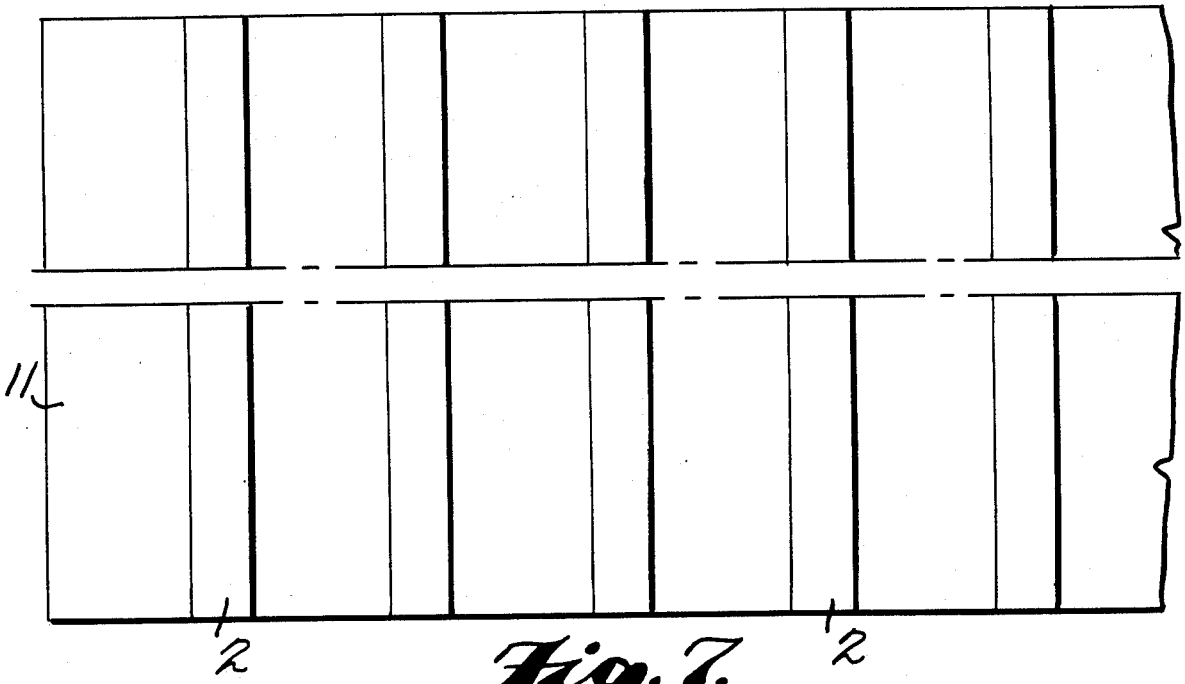
Fig. 7.
Fig. 8.
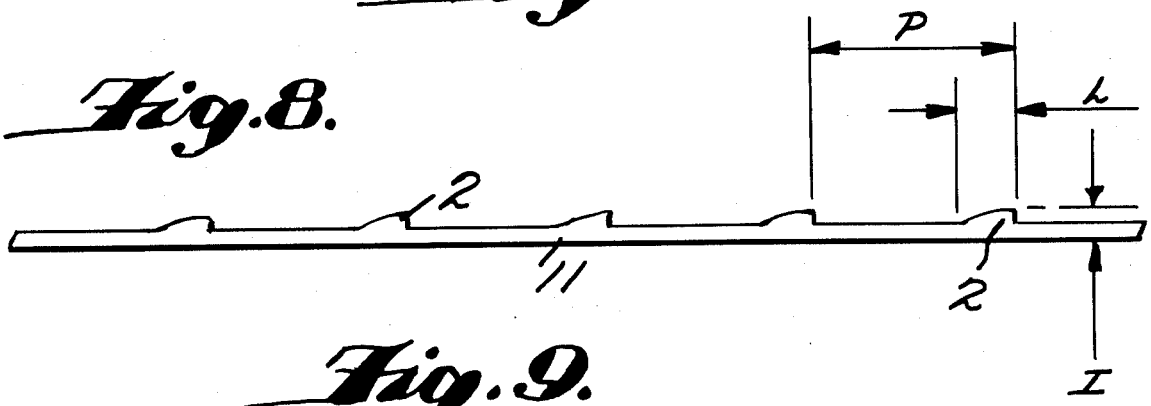
Fig. 9.
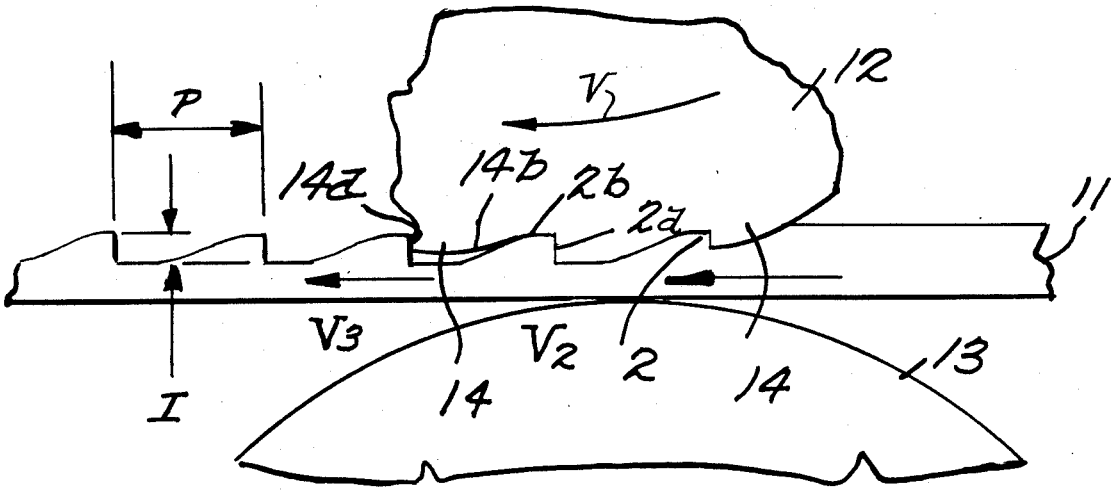

METHOD OF MANUFACTURING A HEAT EXCHANGE PIPE

This is a division of application Ser. No. 538,554, filed Oct. 23, 1983, abandoned.

BACKGROUND OF THE INVENTION

This invention relates to heat-exchanging pipes provided with ribs on an inside surface thereof for causing turbulent flow and to a method of manufacturing a heat-exchanging pipe.

Heat-exchanging pipes are utilized in many kinds of systems. For example, the pipes shown in U.S. Pat. No. 3,861,422 —McLain (Jan. 21, 1974) and U.S. Pat. No. 3,906,605—McLain (Sept. 23, 1975) are used to cool steam that is present around the ouside of the pipe by means of a current of cooling water flowing through the pipe. The pipes are formed with rod-shaped ribs along the longitudinal direction of the inside face of the pipe in order to create turbulent flow, and thereby raise the heat-exchanging efficiency of the pipe.

The heat-transmission characteristics of such heat-exchanging pipes are improved by the formation of ribs on the inner surface of the pipe by causing turbulence when the fluid collides with them the turbulence being insufficient to substantially increase pressure loss. Previously, such ribs have been made of square cross-section for the fluid to collide with them.

However the heat-exchanging pipes shown in U.S. Pat. No. 3,906,605 do not sufficiently raise the heat-exchanging efficiency for many heat exchanging pipe applications. It has become important, especially in recent years, that the efficiency of heat-exchanging pipes be further increased because they are now being used in subterranean and ocean heat generating systems where the temperature difference between inside and outside of the pipe is smaller than in conventional systems into which heat exchanging pipes have traditionally been incorporated.

Since it is difficult to perform cutting on the interior of a smooth pipe, an effective method of pipe-making is to form ribs on sheet material such as a sheet metal and then form this sheet material into a tube and weld the two side edges thereof to join them. Two known methods of forming the ribs in the sheet material are cutting and pressing.

If the ribs are formed by a cutting operation using a milling cutter or the like, considerable time is required for the cutting operation, leading to high production costs. If press working is employed, though the efficiency of the operation is high, the (square) shape of the rib cross-section is not conductive to plastic flow of the sheet material, making it difficult to achieve accurate formation of the ribs Referring to FIGS. 1–3, there is shown a known heat exchange pipe 101 for improving a heat transmission characteristic, as shown in Japan laid open patent (Tokkosho No. 55-43360)-Itho (Mar. 27, 1978). Grooves 102, are formed on an inner surface 103 pipe 101 However, grooves 102 which are essentiallay below the inner surface o pipe 101 do not sufficiently enhance turbulence Note that forming grooves 102, as shown, leaves what are, in essence, symmetrical raised portions having lengths $L_o$ greater than bottom width $l_o$ of the grooves. Fluid flowing in pipe 101 will tend to slide over surface 103. Therefor, pipe 101 cannot produce sufficient turbulence to improve heat-transmission characteristics.

Manufacture of the FIGS. 1–3 pipe is also a problem. If this pipe were manufactured by roll forming with the axial length $L_o$ of ribs 104 being longer than $l_o$ of grooves 102 there would be an interference caused between teeth of a forming roll (not shown) and wall portions 105 of grooves 102 or ribs 104. They would tend to be deformed in manufacture.

SUMMARY OF THE INVENTION

It is accordingly an object of this invention to provide new and improved heat-exchanging pipes and a manufacturing process for forming a heat exchange enchancement pattern on metal strip which is then formed into welded piping.

Another object of this invention is to provide heat-exchanging pipes, providing a turbulent flow therethrough, which can be easily and inexpensively manufactured while maintaining a high degree of accuracy.

In the heat-exchanging pipe of this invention, the shape of the ribs for formation of turbulence that are formed on the inside of the pipe includes upstanding faces that are formed on the upstream side of the direction of flow of the fluid flowing through the interior of the pipe and gently inclined faces that descend from the top end of the upstanding faces in the downstream direction of the fluid flow.

In the method of manufacturing heat-transmission pipes of this invention, by rolling with a forming roll, there are formed in the sheet material ribs consisting of upstanding faces at right angles to the direction of rolling, and gently descending inclined faces. The sheet-material is then subjected to a pipe-forming process to produce a tubular body. Consequently, rib formation can be achieved by roll forming while preventing interference deformation on the ribs.

Other objects and advantages will become apparent from the following description and drawings.

BRIEF DESCRIPTION OF THE DRAWINGS

FIG. 1 (prior art) is a perspective view of a conventional, heat-exchanging pipe;

FIG. 2 (prior art) is a fragmentary longitudinal section view of FIG. 1;

FIG. 3 (prior art) is a fragmentary enlarged detail of FIG. 2;

FIG. 7 is a plan view showing the sheet material, after roll forming, used in the method of manufacture according to this invention;

FIG. 8 is a side view showing the sheet material used in the method of manufacture of the present invention;

FIG. 9 is a diagram of the step of rib formation in the sheet material during roll-forming in the method of manufacture of this invention;

DETAILED DESCRIPTION OF THE PREFERRED EMBODIMENTS

Figure 4:
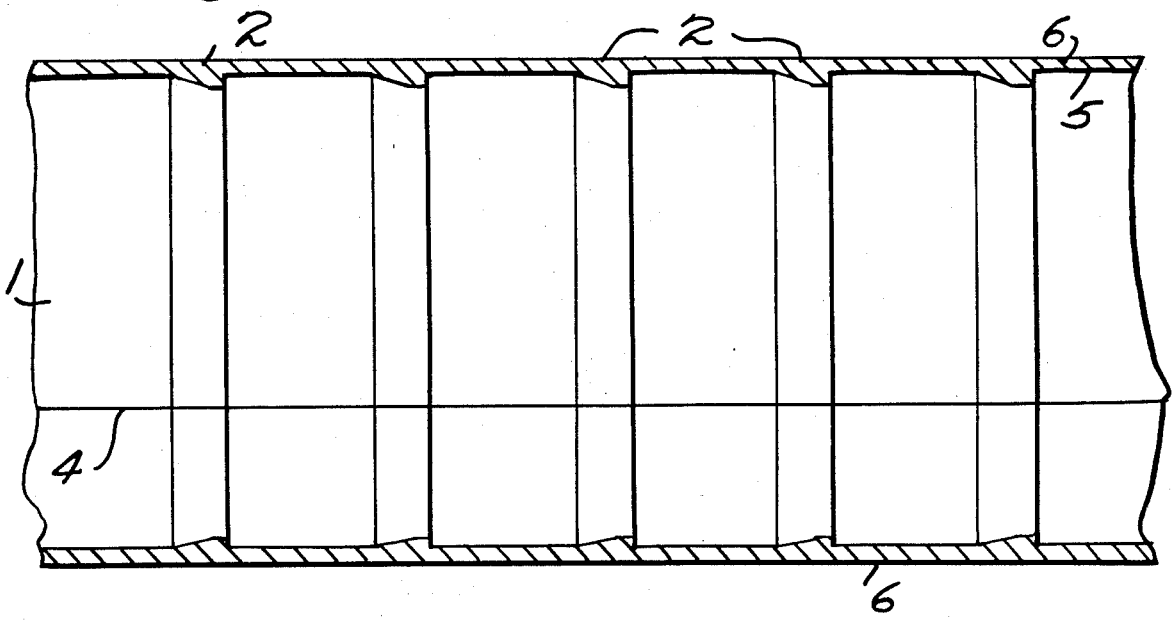
FIG. 4 is an axial section of a heat exchanging pipe according to the present invention.
Figure 5:
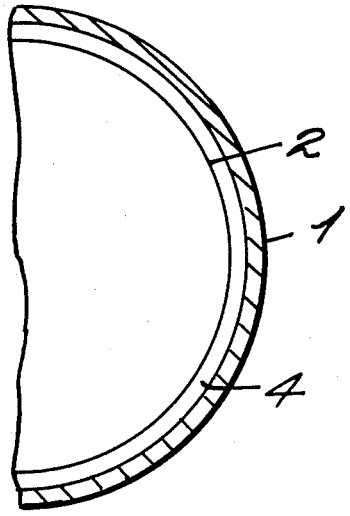
FIG. 5 is a transverse section of a heat exchanging pipe according to the present invention.

Referring now to FIGS. 4 and 5, there are shown axial and transverse sections of a first embodiment of a heat-exchanging pipe according to this invention. A pipe of circular cross-section is made of a metal such as for example, titanium or stainless steel. The inside surface of the pipe is formed with ribs 2 for causing turbulence. These ribs are formed in the circumferential direction of the pipe and with a separation between ribs in the longitudinal direction of the pipe, on the inside face 5 (shown most clearly in FIG. 6) of pipe 1.

These ribs 2 are shaped as rings extending in the circumferential direction of the pipe 1, and their shape is constituted by upstanding faces 2*a* that stand at right angles to the longitudinal direction of the pipe and are on the upstream side of the flow direction of the fluid flowing through the inside of the pipe 1, and gently-sloping inclined faces 2*b* that descend from the top end of these upstanding faces 2*a* in the direction of flow of the fluid.

Pipe 1 has a longitudinally extending weld seam 4 since it is formed from metal strip which has been patterned and then curved and welded into a cylindrically-shaped pipe. The ribs are not necessarily the same on the outside surface 6 of the pipe 1. For example, a diamond type enhancement pattern could be employed on the outside 6 of the pipe 1 as described in U.S. Pat. No. 3,861,462.

Figure 6:
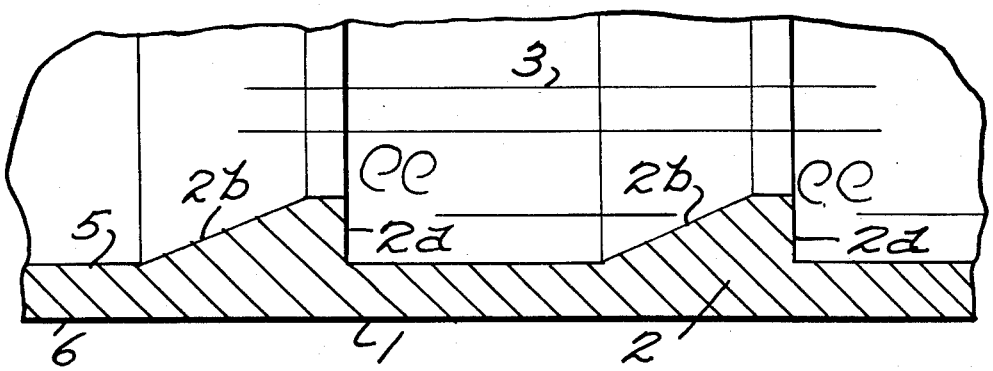
FIG. 6 is a cross-section of the turbulence-forming portions of the heat-exchanging pipe according to the present invention.

As shown in FIG. 6, with such a heat-exchanging pipe, when a fluid 3 such as for example water is caused to flow through the interior of the pipe 1 in the direction shown in the drawing, part of the fluid that is flowing along the inside face of the pipe 1 collides with upstanding faces 2*a* that are formed on the upstream side in the direction of flow of the fluid on the ribs 2. This causes the fluid to rise, forming turbulent flow. Due to this turbulent flow, the thermal conductivity from the fluid 3 to pipe 1 is raised, so that heat is more efficiently conducted to the fluid, such as for example steam, that is present outside the pipe 1. The upstanding faces 2*a* constitute the effective faces of the ribs 2 for the purposes of generating turbulent flow of the fluid 3.

Therefore the heat-exchanging pipe according to this invention is particularly well suited for use in an apparatus where the outside surface 6 provides condensation.

The method of manufacture according to this invention will now be explained for the embodiment as shown in FIG. 4 and FIG. 5. As shown in FIGS. 7 and 8, a metal strip 11 is prepared, and rolled as shown in FIG. 9 using a forming roll 12 and levelling roll 13, to form a plurality of ribs 2 in the surface of the metal strip 11, spaced in the rolling direction (longitudinal direction of the strip), and extending at right angles to the direction of rolling. The forming roll 12 is formed with teeth 14 spaced in the circumferential direction and extending in the axial direction of the roll, these teeth having upstanding faces 14*a* and inclined faces 14*b* corresponding in cross-section to the ribs 2. Thus when the strip 11 is fed between the forming roll 12 and levelling roll 13, it is rolled between the two rolls 12 and 13 to form ribs 2 on its upper surface. When the strip 11 supported by the level roll 13 passes below the forming roll 12, the teeth 14 of the rotating forming roll 12 press the strip 11 as it is being drawn in on the upstream side. Ribs 2 are therefore formed in the strip 11 as it is rolled, by the teeth 14 of the forming roll 12, these ribs extending in the width direction of the upper surface and being formed in a continuous sequence in the longitudinal direction. The sheet material is then fed out from the forming roll 12 in the downstream longitudinal direction.

The shape, described above, of the ribs 2 formed on the strip 11 prevents interference deformation of rib 2 from being produced when they are formed by rolling. In rolling in general, a forming roll 12 is arranged to reduce the mean thickness of the strip 11 after rolling compared to its thickness before rolling in a certain ratio determined taking into consideration plastic flow of the material. Strip 11 is therefore increased in longitudinal length without much change in its width dimension. Consequently, as shown in FIG. 9, the speed of movement of the strip 11 varies in three stages, namely, a speed V1 before rolling that is slower than the peripheral speed V of the forming roll 12; and speed V2 during rolling that is the same as the peripheral speed V of the forming roll; and a speed V3 after rolling that is faster than the peripheral speed V of the roll (V3 V2 V1). Thus, when forming the ribs 2 by rolling, since the strip 11 moves, as mentioned above, with a greater speed after rolling that it does during rolling, if the ribs were square in shape, as they are conventionally, the ribs formed on the strip 11 after rolling would collide with the teeth of the forming roll 12 i.e. they interfere with them. In order for it to be capable of plastic deformation, the strip 11 is made of soft metal, so the ribs will often be deformed by collison with the teeth of the forming roll 12. However, with this invention, the ribs 2 formed on the strip 11 are of a shape provided with upstanding faces 2*a* on the portions in the upstream direction with respect to the direction of fluid flow, these constituting the effective faces for the generation of turbulence in the fluid, and with inclined faces 2*b*, respectively, on the downstream direction, that do not contribute directly to the generation of turbulence but descend smoothly in the downstream direction of the flow, in order to avoid the teeth 14 of the forming roll 12 during rolling.

Corresponding to this, the teeth 14 of the forming roll 12 are likewise formed with upstanding faces 14*a* facing in the direction of roll rotation, and with smoothly inclined faces 14*b* respectively, facing in the opposite direction to the roll rotation. Thus the effect of the cooperation between the inclined faces 14*b* of the teeth 14 and the inclined faces 2*b* or the ribs 2 when the ribs 2 are formed on the strip 11 by the forming roll 12 is that these inclined faces 14*b* separate from the inclined faces 2*b* of the ribs 2 when the teeth 14 separate from the sheet material 11. The inclined faces 2*b* of the ribs 2 are relieved from the teeth 14 of the forming roll 12 so that they do not collide with them after rolling. Consequently, even though after rolling the strip 11 moves with a greater speed than it does during rolling, the ribs 2 can be prevented from deformation caused by being pressed against the teeth 14 because collision and interference of the ribs 2 with the teeth 14 of the forming roll 12 can be avoided.

After the strip has been patterned, it is formed into the shape of a pipe by well known pipe forming techniques. Generally this comprises forming the strip gradually into the shape of a pipe by passing it through a series of roll forming stands or dies. After the strip has been formed into the shape of a pipe the longitudinally extending edges of the strip are joined together by conventional means, preferably, by welding and, most preferably, by high frequency welding.

The tubing thus formed may be subjected as desired to shaping and/or sizing by conventional means and any other further processing as, for example, cleaning, coiling and/or packaging.

Figure 10:
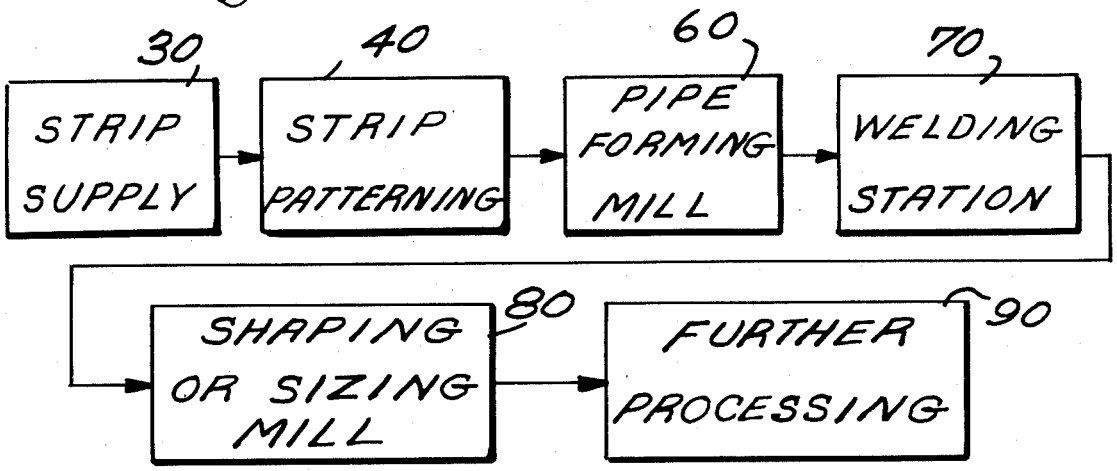
FIG. 10 is a schematic representation of an apparatus for carrying out the method steps of manufacture in accordance with this invention.

The apparatus for practicing the process in accordance with this invention and for forming the tubing in accordance with this invention is shown schematically in FIG. 10. The apparatus comprises supply means 30 or a supply of metal strip; patterning means 40 for forming one surface of the metal strip; tube forming means 60 for forming the metal strip into the shape of a pipe and joining means 70 for joining the longitudinally extendingly edges of the strip to form the complete tube.

The apparatus may also include shaping and/or sizing means 80 as for example to correct out of roundness and properly size the joined tube. It may also include means for further processing 90 the tubing as, for example, means for cleaning the tube, and means for coiling the tubing.

The particular apparatus for carrying out each of these functions may be of any conventional well known design. The supply means 30 generally comprises a supply of metal strip in the form of a coil. The pipe forming means 60 generally comprises a plurality of in line pipe forming roll stands or dies as are well known in the art.

The joining means 70 in accordance with this invention preferably comprises though it is not limited to a high frequency forge welding station as set forth in U.S. Pat. No. 3,037,105, granted May 29, 1962. The shaping and/or sizing means 80 generally comprises a series of in line roll or die stands.

The cleaning means 90 and the coiling means 90 may be any conventional means for coiling tubing. The strip patterning means 40 is preferably the one described in U.S. Pat. No. 3,861,462 granted Jan. 21, 1975.

Experiments were carried out with the heat-exchanging pipe which has the height H of the ribs 2 of 0.1–10 mm, the separation P of the ribs 2 of 3–100 m and the length L of the declined surface of the ribs 2 of 3–60 mm in order to determine the heat transmission efficiency of the pipe.

When heat-exchanging pipes, as described above, were used with water flowing through them in a heat exchanger to cool steam present around the outside of the pipes, the heat transmission efficiency was raised by a factor of 1.5 compared with the use of unribbed heat-exchanging pipes.

Figure 11:
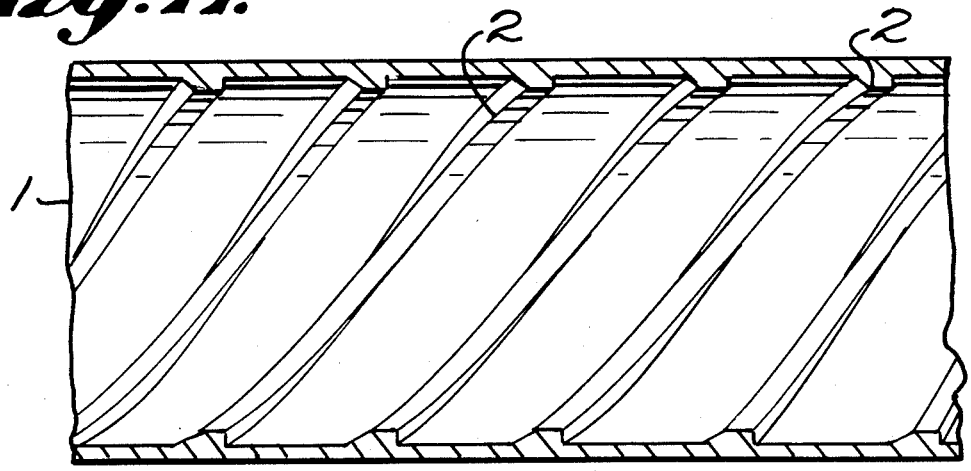
FIG. 11 and FIG. 12 are axial sectional views of heat exchanging pipe according to alternative embodiments of this invention.
Figure 12:
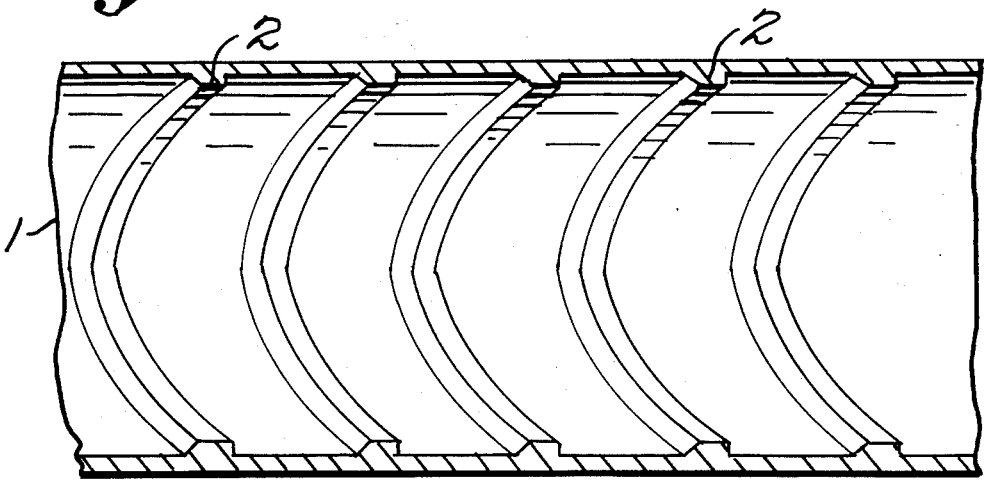

Ribs 2 formed on the inside of the pipes 1 in the case of heat-exchanging pipes according to this invention do not have to make a right angle with respect to the longitudinal direction of the pipe; they could be of a spiral shape or be inclined with respect to the longitudinal direction, as shown in FIG. 11 and FIG. 12.

With heat-exchanging pipes according to this invention and the method of manufacture thereof, as explained above, the ribs for the formation of turbulence on the inside face of the pipe can be easily and inexpensively formed by roll-forming, and deformation due to interference of the ribs on roll forming can be prevented enabling the ribs to be accurately formed.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A method of manufacturing a heat-exchanging pipe comprising the steps of:

providing a metal strip;

first forming in the metal strip, by rolling with a forming roll having a peripheral edge which moves at a peripheral speed, a plurality of ribs each shaped to have an upstanding face in a direction perpendicular to a direction of rolling and a gently inclined face that descends from an upper end of the upstanding face, this first forming step including the steps of:

moving the metal strip at a speed V1 before the metal strip is rolled by the forming roll, the speed V1 being slower than the peripheral speed of the forming roll;

moving the metal strip at a speed V2 while the metal strip is being rolled by the forming roll, the speed V2 being substantially equal to the peripheral speed of the forming roll; and moving the metal strip at a speed V3 after the metal strip has been rolled by the forming roll, the speed V3 being faster than the peripheral speed of the forming roll;

second forming the strip into a tubular shape along the direction of rolling in such a way that the ribbed surface is on the inside; and permanently joining the edges of the strip to form a pipe.

* * * * *